US011550266B2

(12) United States Patent
Lagorgette et al.

(10) Patent No.: US 11,550,266 B2
(45) Date of Patent: Jan. 10, 2023

(54) TIMEPIECE CAPABLE OF INDICATING THE POSITION OF THE SUN WITH RESPECT TO THE HORIZON ANYWHERE IN THE WORLD

(71) Applicant: ETA SA Manufacture Horlogere Suisse, Grenchen (CH)

(72) Inventors: Pascal Lagorgette, Bienne (CH); Raphael Balmer, Vicques (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 654 days.

(21) Appl. No.: 16/589,277

(22) Filed: Oct. 1, 2019

(65) Prior Publication Data

US 2020/0125033 A1 Apr. 23, 2020

(30) Foreign Application Priority Data

Oct. 23, 2018 (EP) ..... 18202146

(51) Int. Cl.
*G04B 19/26* (2006.01)
*G04G 9/00* (2006.01)

(52) U.S. Cl.
CPC ..... *G04B 19/26* (2013.01); *G04G 9/0076* (2013.01)

(58) Field of Classification Search
CPC ..... G04B 19/26; G04G 9/0076
See application file for complete search history.

(56) References Cited

U.S. PATENT DOCUMENTS

2018/0004162 A1* 1/2018 Capt ..... G04B 19/268

FOREIGN PATENT DOCUMENTS

| | | | |
|---|---|---|---|
| AT | 13 049 | U1 | 5/2013 |
| CN | 106909056 | A | 6/2017 |
| CN | 107577135 | A | 1/2018 |
| DE | 40 37 750 | A1 | 6/1992 |
| EP | 2 988 176 | A2 | 2/2016 |
| ES | 2 550 255 | B1 | 8/2016 |
| JP | 9-257954 | A | 10/1997 |
| JP | 09-257954 | A | 10/1997 |
| JP | 2019-144127 | A | 8/2019 |
| WO | WO 02/054157 | A1 | 7/2002 |
| WO | WO 2014/182162 | A2 | 11/2014 |

(Continued)

OTHER PUBLICATIONS

Machine Translation of CN 106909056 (Year: 2022).*

(Continued)

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A timepiece including a timepiece movement and sunrise and sunset indicating device that take account of the date and geolocation of the user, the device including a first device for receiving the current date, a second device for receiving a geolocation signal, and a disc bearing a representation of the sun, arranged to be capable of pivoting about an axis passing through the centre of the disc. The sunrise and sunset indicating device include a movable horizon arranged to move above the disc and to indicate the position of the sun with respect to the horizon.

9 Claims, 2 Drawing Sheets

(56) References Cited

FOREIGN PATENT DOCUMENTS

| | | |
|---|---|---|
| WO | WO 201 8/015440 A1 | 1/2018 |
| WO | WO 2018/015440 A1 | 1/2018 |

OTHER PUBLICATIONS

Machine Translation of WO2018015440 (Year: 2022).*
Japanese Office Action dated Sep. 8, 2020 in Japanese Patent Application No. 2019-169041 (with English translation), 9 pages.
Combined Chinese Office Action and Search Report dated Jan. 20, 2021 in corresponding Chinese Patent Application No. 201911005499.4 (with English Translation and English Translation of Category of Cited Documents) citing documents AO-AQ therein, 13 pages.
European Search Report dated Apr. 17, 2019 in European Application No. 18202146.9 filed on Oct. 23, 2018 (with English Translation of Categories of Cited Documents).

* cited by examiner

TIMEPIECE CAPABLE OF INDICATING THE POSITION OF THE SUN WITH RESPECT TO THE HORIZON ANYWHERE IN THE WORLD

CROSS-REFERENCE TO RELATED APPLICATION

This application claims priority to European Patent Application No. 18202146.9 filed on Oct. 23, 2018, the entire disclosure of which is hereby incorporated herein by reference.

FIELD OF THE INVENTION

The invention concerns a timepiece comprising a sunset and sunrise display device for watches, comprising first means for calculating or for receiving the current date and second means for receiving a geolocation signal.

The invention also concerns a portable assembly comprising such a watch and a mobile telephony device arranged to provide a geolocation and/or date signal or information to said watch.

BACKGROUND OF THE INVENTION

The duration of the day is the time comprised, each day, from the moment when the upper limb of the sun appears above the horizon in the east, at sunrise, until it disappears below the horizon in the west, at sunset. Whatever the time, there is always one half of the earth's surface which is illuminated by the sun, and another half which is in darkness.

Generally, the length of day varies throughout the year and also depends on latitude. This variation is caused by the tilt of the axis of rotation of the earth on itself with respect to the ecliptic plane. This tilt by definition corresponds to the latitude of the tropics which is ±23° 27'. As is well known, the length of day is shortest at the December Solstice in the Northern Hemisphere, and at the June Solstice in the Southern Hemisphere. At the equinoxes, the length of day and night are equal everywhere on earth.

Most watches with a sunrise and sunset display offer a display suitable for the temperate regions, but this display is not compatible with the position of the sun with respect to the horizon from the tropical or equatorial regions.

SUMMARY OF THE INVENTION

The invention proposes to provide the user with a display of the position of the sun consistent with the place where he is located.

To this end, the invention concerns a watch comprising a device displaying the position of the sun for watches according to claim 1.

The invention concerns a portable assembly comprising such a watch and a mobile telephony device arranged to provide a geolocation signal or information and/or a signal or information indicating the terrestrial hemisphere of a place, and/or a date signal or information to such a device comprised in said watch.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
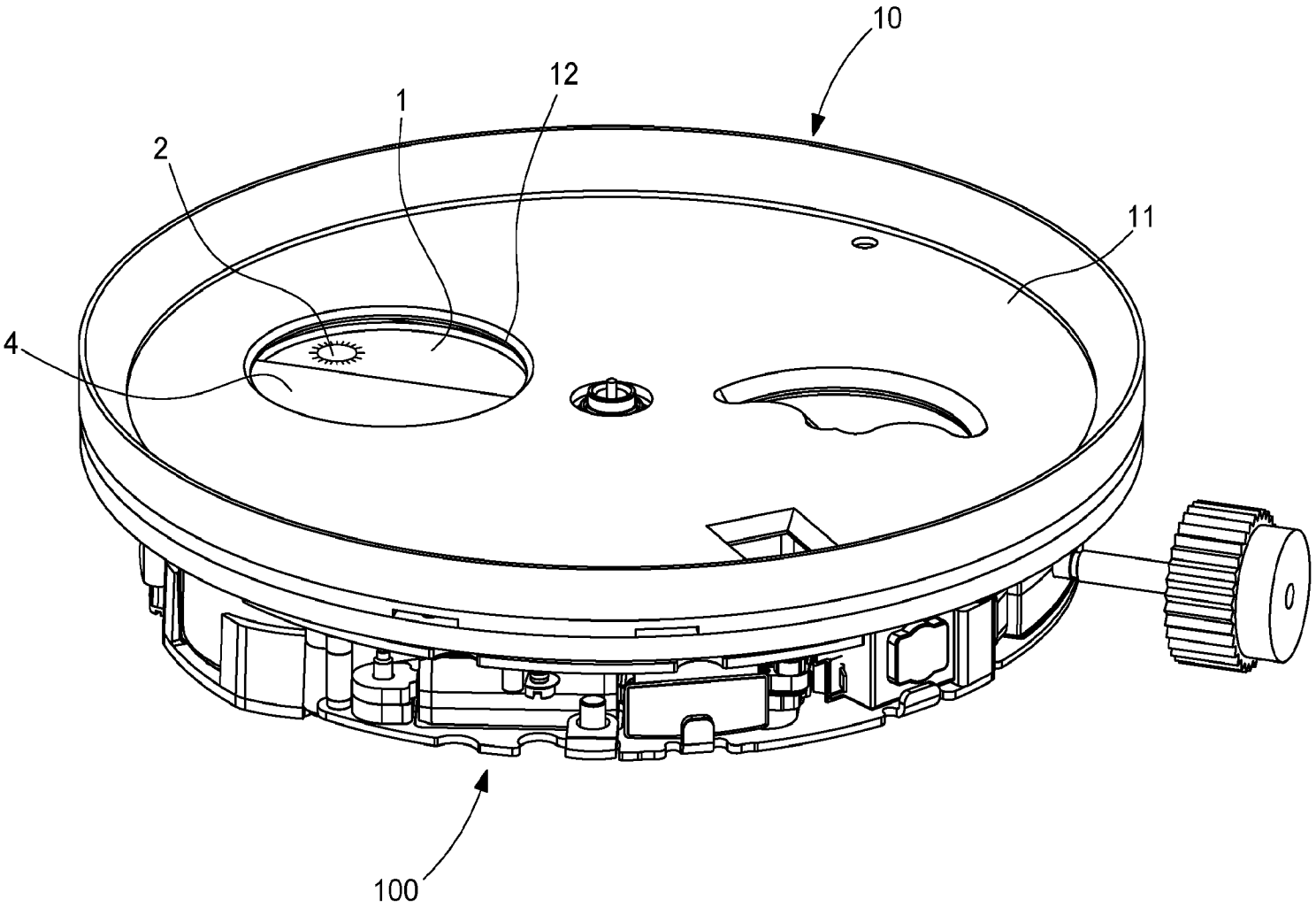
FIG. 1 represents a perspective view of a watch according to the invention.

The invention therefore concerns a watch 10 comprising a sunrise and sunset display device for displaying the position of the sun with respect to the horizon in the place where the user is located.

Device 10 comprises first means for calculating or receiving the current date, and second means for receiving a geolocation signal.

The watch also includes a display disc 1 which includes at least one representation of the sun 2, and first drive means for driving disc 1, at a rate of one revolution in 24 hours.

More particularly, the first drive means include at least a first electric motor for driving in rotation disc 1 at a rate of one complete revolution in 24 hours; the motor can drive disc 1 directly or indirectly via a suitable kinematic chain.

According to the invention, watch 10 includes a movable horizon 4 with respect to which disc 1 can move. More particularly, this movable horizon 4 forms a cover superposed on a portion of disc 1, horizon 4 being movable in translation with respect to disc 1, to provide a realistic depiction of the position of the sun in the sky.

The position calculating means can advantageously utilise second geolocation signal receiving means in order to determine the latitude of the place. The use of this parameter can provide a display with a much more realistic depiction of the position of the sun.

Advantageously, the position calculating means are arranged to calculate the latitude of the place where the device is located, and to control the second drive means comprised in the device to move the movable horizon with respect to the disc bearing the representation of the sun.

According to the invention, these second drive means include a rack 5 mounted integral with horizon 4, rack 5 being driven by means of a pinion 6 coupled to a motor to move horizon 4.

Figure 2:
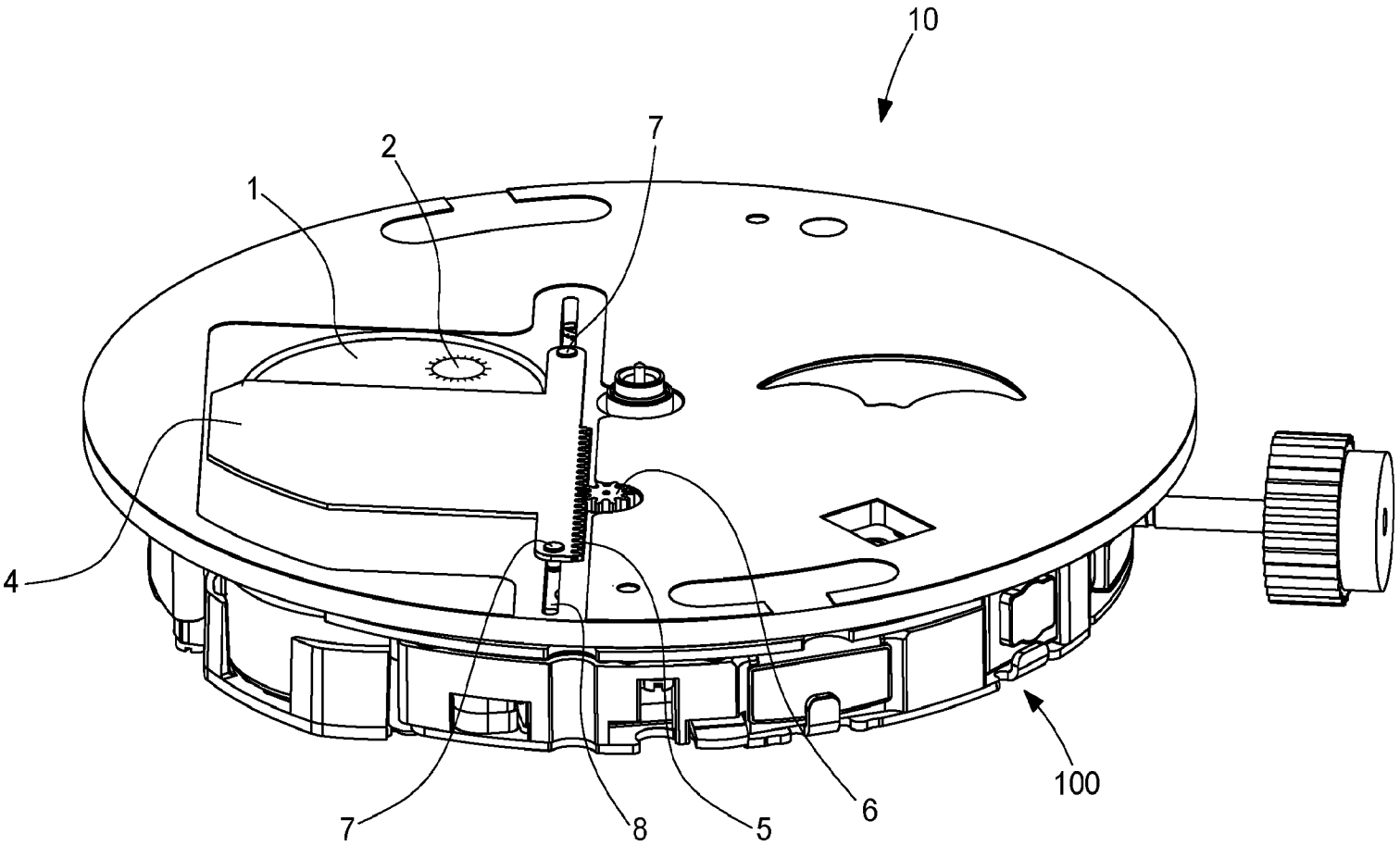
FIG. 2 represents, in a similar manner to FIG. 1, the sunset and sunrise display device of a watch according to the invention.

As represented in FIG. 2, rack 5 is guided in translation by means of pins 7 sliding in a groove 8 made in watch 10.

In a first variant, horizon 4 is opaque in order to conceal the representation of the sun when it is night in the place where the user is located.

In a second variant, horizon 4 is semi-transparent so that the user can predict sunrise by consulting his watch 10.

As represented in FIGS. 1 and 2, the device displaying the position of the sun is mounted underneath dial 11 and the position of sun 2 with respect to horizon 4 is visible through a circular opening 12 made in the dial.

Taking account of latitude for a realistic display, with a horizon that is movable, with respect to the sun disc, thus makes it possible to offer a functionality which is not generally well handled in day phase displays.

Advantageously, the first current date calculating or receiving means are means for receiving a signal transmitted by a satellite or by a mobile telephony device arranged to be carried by the user of watch 10.

In a variant, the second means for receiving a geolocation signal and/or a signal indicating the terrestrial hemisphere of the place are means for receiving a signal transmitted by a satellite or by a mobile telephony device arranged to be carried by the user of watch 10.

Such a mobile telephony device may consist of a 'smartphone' or similar, with which watch 1000 can exchange information, without necessarily involving action by the user by means of a Bluetooth connection, for example.

The user's location is made known to the mobile telephony device by various techniques:

GPS which gives longitude and latitude;

presence in a country that is determined both by GPS and the cellular network to which the telephone is connected.

The mobile telephony device can transmit this information in different formats:

latitude: positive in the northern hemisphere-negative in the southern hemisphere;

in some coding bits (2 bits): northern hemisphere-southern hemisphere-Equator-Pole.

country code used to determine whether a daylight saving time correction needs to be made.

An algorithm makes it possible to accurately predict the sunrise and sunset as a function of the date and geolocation, and thus to move the position of horizon 4 as a function of the date and geolocation, with the sun rotating at a constant speed.

The invention also concerns a portable assembly, comprising such a watch 10, and a mobile telephony device arranged to provide a geolocation signal or information and/or a signal or information indicating the terrestrial hemisphere of the place, and/or a date signal or information to watch 10.

The connection between a mobile telephony device 100 and a watch 1000 allows for automatic adjustment, without user intervention.

The invention claimed is:

1. A timepiece comprising:

a timepiece movement and sunrise and sunset indicating means that take account of the date and geolocation of the user, said means comprising first means for receiving the current date, second means for receiving a geolocation signal, and a disc bearing a representation of the sun, arranged to be capable of pivoting about an axis passing through the centre of the disc, wherein the sunrise and sunset indicating means comprise a movable horizon arranged to move above the disc and to indicate the position of the sun with respect to the horizon, wherein said horizon includes a rack arranged to cooperate with a pinion kinematically connected to the timepiece movement, and wherein the rack is guided in translation by a pair of pins extending downward from the horizon to slide in a groove made in the timepiece movement, the pair of pins move in translation with the rack and the horizon, and the pair of pins includes a first pin arranged on an opposite side of the movable from a second pin.

2. The timepiece comprising sunrise and sunset indicating means according to claim 1, wherein said movable horizon and the rack are in one piece.

3. The timepiece comprising sunrise and sunset indicating means according to claim 1, wherein the horizon is opaque.

4. The timepiece comprising sunrise and sunset indicating means according to claim 1, wherein the horizon is semi-transparent.

5. The timepiece according to claim 1, wherein said first means for receiving the current date are means for receiving a signal transmitted by a satellite or by a mobile telephony device arranged to be carried by the user of said watch.

6. The timepiece according to claim 1, wherein said second means for receiving a geolocation signal and/or a signal indicating the terrestrial hemisphere of a place are means for receiving a signal transmitted by a satellite or by a mobile telephony device arranged to be carried by the user of said watch.

7. A portable assembly comprising a watch according to claim 1 and a mobile telephony device arranged to provide a geolocation signal or information and/or a signal or information indicating the terrestrial hemisphere of a place, and/or a date signal or information to said watch.

8. The timepiece according to claim 1, wherein said rack extends outwardly from a perimeter of the horizon.

9. The timepiece according to claim 1, wherein said horizon is positioned between the first pin and the second pin.

* * * * *